United States Patent [19]

Hess et al.

[11] 3,981,172

[45] Sept. 21, 1976

[54] METHOD AND APPARATUS FOR EXPANDING SPIRALLY WELDED PIPE

[75] Inventors: Johann T. Hess, Deerfield; Frederick C. Kucklick, Buffalo Grove, both of Ill.

[73] Assignee: Grotnes Machine Works, Inc., Chicago, Ill.

[22] Filed: Sept. 22, 1975

[21] Appl. No.: 615,490

[52] U.S. Cl. ..... 72/370; 72/393; 269/48.1

[51] Int. Cl.[2] ..... B21D 41/02; B21D 31/04

[58] Field of Search ..... 72/393, 392, 465, 370, 72/367, 368, 150; 269/48.1; 219/62; 228/17, 17.5, 17.7, 141, 143

[56] References Cited

UNITED STATES PATENTS

| | | | |
|---|---|---|---|
| 2,780,271 | 2/1957 | Ewart et al. | 72/393 X |
| 2,873,353 | 2/1959 | Rudd | 219/62 |
| 3,056,197 | 10/1962 | Lawson | 72/370 X |
| 3,073,945 | 1/1963 | Osterer et al. | 219/62 X |
| 3,289,451 | 12/1966 | Koch et al. | 72/370 X |

*Primary Examiner*—C.W. Lanham
*Assistant Examiner*—James R. Duzan
*Attorney, Agent, or Firm*—Leydig, Voit, Osann, Mayer & Holt, Ltd.

[57] ABSTRACT

A method and apparatus for mechanically expanding pipe of the type having a helical weld seam which includes a radially expandable die head assembly for incrementally expanding the pipe advanced over the die head and wherein the die head has a helical groove which corresponds to the helical weld seam of the pipe. Means are provided for advancing the pipe longitudinally over the die head assembly for incremental expansion and preferably for substantially simultaneously rotating the pipe to maintain the conformity between the die head groove and the helical weld seam of the pipe.

6 Claims, 3 Drawing Figures

METHOD AND APPARATUS FOR EXPANDING SPIRALLY WELDED PIPE

DESCRIPTION OF THE INVENTION

The present invention relates generally to pipe expanding methods and apparatus and in its principal aspect concerns an improved method and apparatus for expanding long lengths of large diameter spirally wound and helically welded pipe.

For many years now mechanical expansion of pipe for work hardening, sizing and rounding has been utilized for long sections of large diameter pipe of the type formed with a longitudinally welded seam. An approach which has been used successfully on a commercial scale is described and shown in J. C. Ewart et al. U.S. Pat. No. 2,780,271 which issued Feb. 5, 1957. The apparatus described in the J. C. Ewart et al. patent is entirely satisfactory for incrementally expanding large diameter pipe of the type having a longitudinally welded seam.

In the production of pipe, it is the weld seam which usually requires more attention by way of manufacturing steps and equipment to insure the production of reliable and quality products. When work hardening by mechanical expansion from within is utilized, provision must be made to insure that the integrity of the weld seam is not destroyed or compromised in any way. The apparatus, however, as conventionally made is not suitable for use with pipe having a helically welded seam.

There are numerous benefits to the use of pipe having helically welded seams, for example, the investment and equipment required is greatly reduced by comparison with that needed for production of longitudinally welded pipe. Spirally welded pipe may be made from relatively narrow plates welded end to end, or coil stock, that is formed into continuous cylindrical pipe lengths in a multiple roll station. The ability to use narrower plates further provides the benefit of a reduced width requirement of the plate mill. Also, by changing the helix angle of the pipe, different diameters of pipes can be made from a single plate width. Longer lengths of pipe may be produced with the spirally wound approach, since the pipe is produced on a continuous basis, and the equipment used to produce the pipe has virtually no length restrictions. Even though the foregoing benefits may be derived from the spirally wound pipe, apparatus has not been produced to mechanically expand the pipe on a mass production basis which would be capable of accomplishing the results achieved with mechanically expanded longitudinally welded seam pipe.

Accordingly, it is a general aim of the present invention to provide improved apparatus and a method for mechanically, incrementally expanding helical, welded seam pipe. While not so limited in its application, the invention will find especially advantageous use for incrementally expanding long sections of large diameter helically welded seam pipes.

A related object of the invention is the provision of an improved method and apparatus for expanding helically welded seam pipe for sizing, rounding and work hardening of the pipe, yet wherein such results are achieved without damaging or effecting the integrity of the helically welded seam.

Other objects and advantages of the invention will become apparent as the following description proceeds, taken in conjunction with the accompanying drawings, in which.

Figure 1:
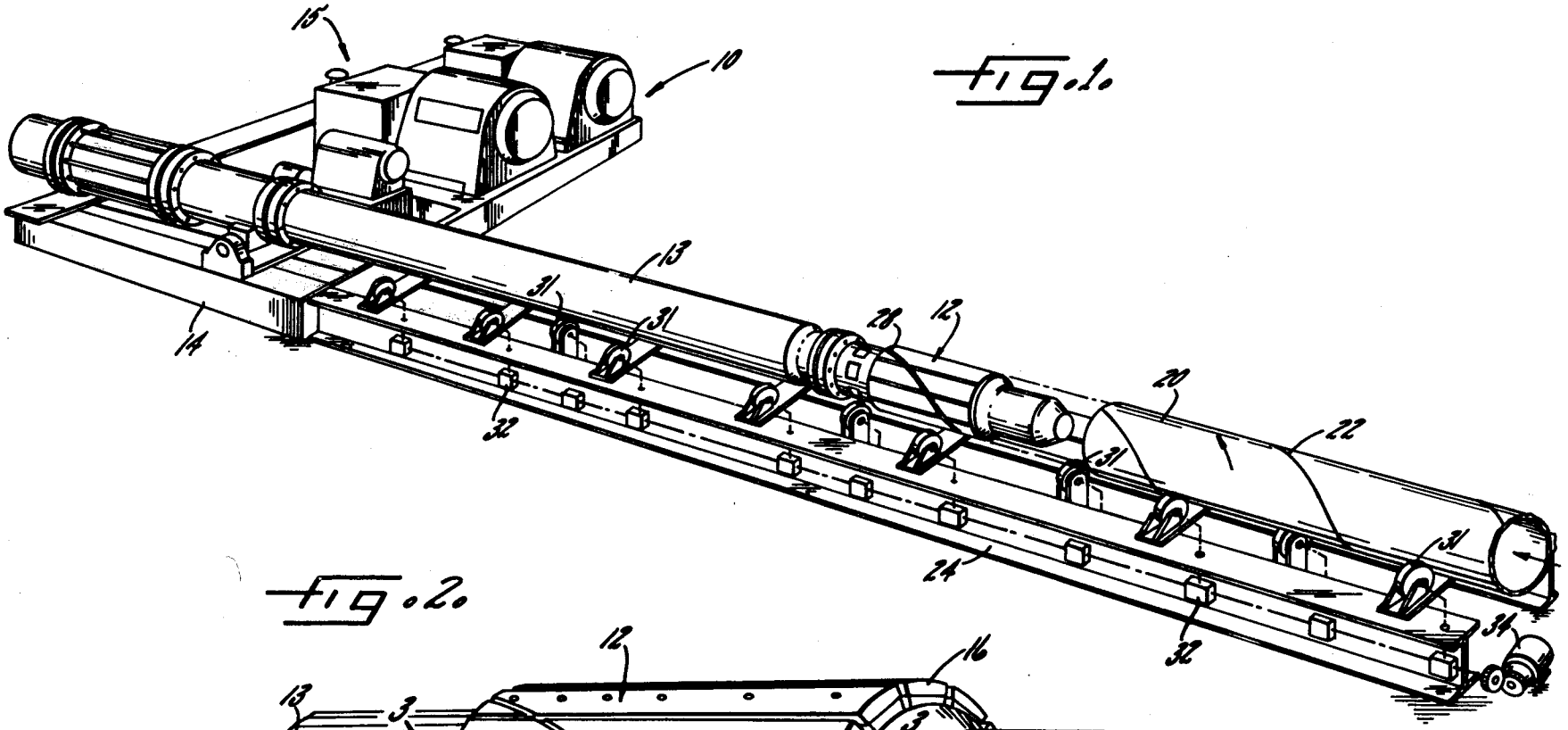
FIG. 1 is a view in perspective of an exemplary expanding apparatus embodying the features of the present invention, such apparatus here shown in readiness to receive a helically welded seam pipe for incrementally expanding the same in accordance with the invention.

While the invention is susceptible of various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents and alternatives falling within the spirit and scope of the invention.

Referring now to FIG. 1, there is shown an exemplary pipe expander unit, indicated generally at 10, which includes an expander head 12 carried by an elongated actuator unit 13 that is cantilever mounted on a support bed 14. Fluid control units 15 serve to operate the actuator which radially expands and contracts the circumferentially disposed dies 16 which make up the head 12. For details of the expander type of construction and typical mode of operation, reference may be made to the aforementioned J. C. Ewart et al. Pat. No. 2,780,271 and the descriptive trade literature available for such units.

An expander of the type illustrated in FIG. 1, may for example be capable of expanding pipe on the order of approximately up to 80 feet in length and having diameters ranging on the order of 24 inches to 64 inches with wall thicknesses on the order of up to 1½ inches.

In accordance with the present invention, provision is made for expanding a pipe 20 of the type having a helical welded seam 22 and for moving the pipe over the expander head. The pipe 20 is carried by a conveyor support 24.

Figure 2:
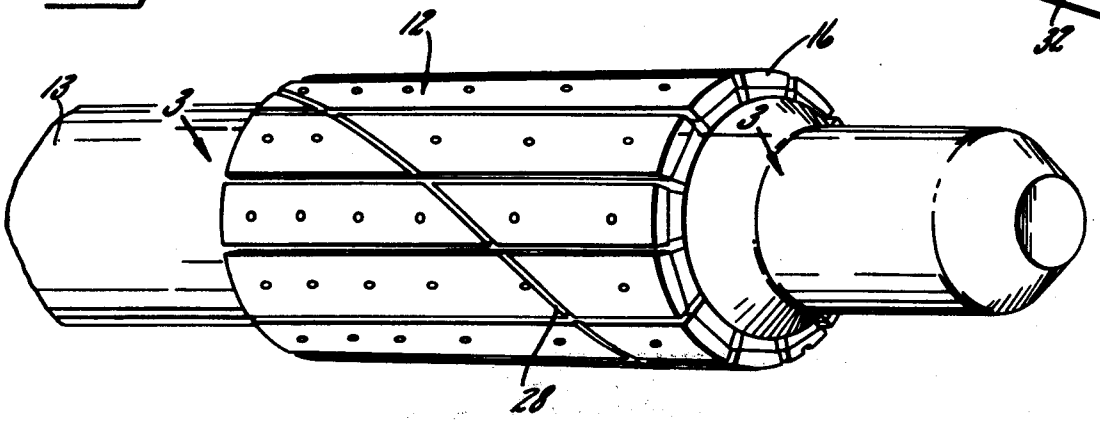
FIG. 2 is an enlarged perspective view of the expander die assembly including the features of the present invention.
Figure 3:
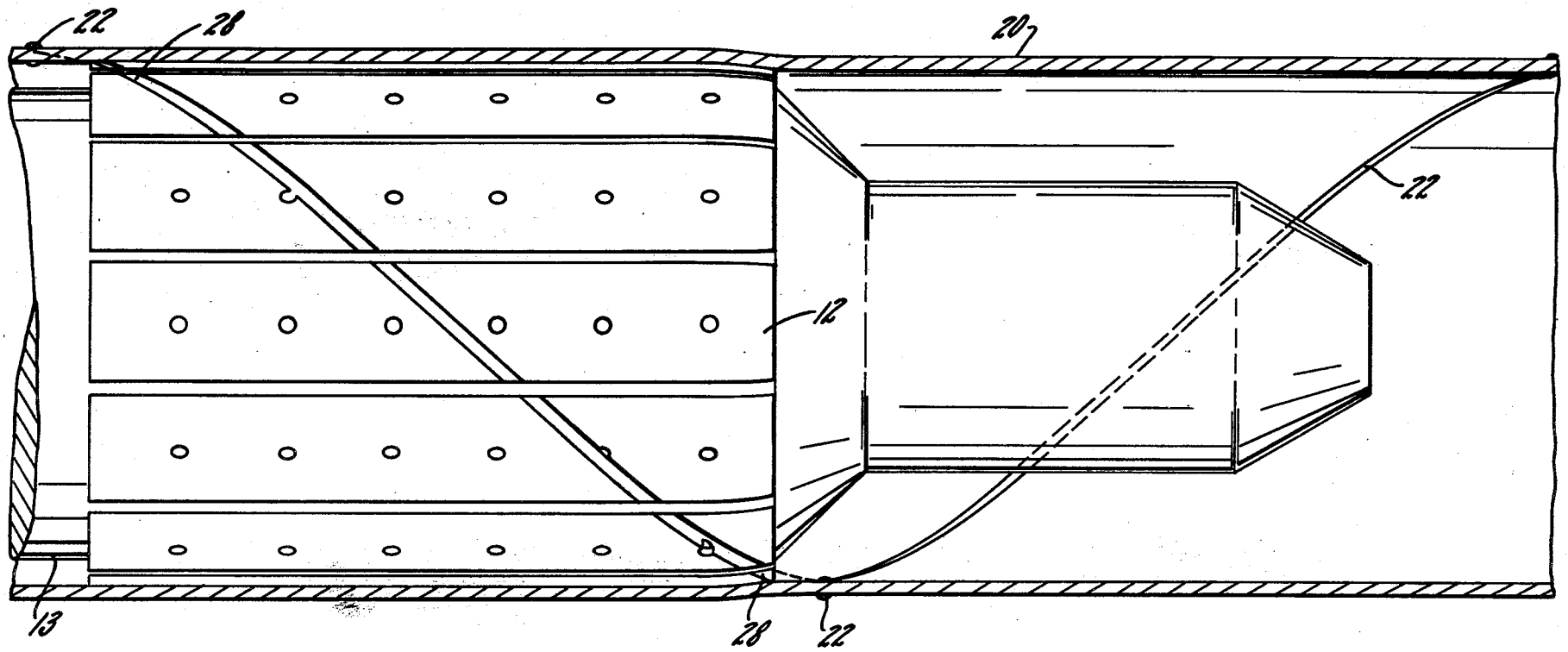
FIG. 3 is a transverse section view taken substantially along the line 3—3 in FIG. 2 here showing a fragmentary portion of a pipe being expanded.

In carrying out the present invention, referring to FIG. 2, the expander head 12 includes a helical groove 28 disposed in the outer surface of the dies 16 which make up the die assembly of the head. The pitch or lead of the groove 28 substantially conforms to the pitch or lead of the helical weld seam 22 of pipe to be expanded. The helical groove on the outer surface of the dies is preferably made to a helix angle slightly different from the finished angle of the finally formed pipe, and is slightly greater in width than the nominal width of the weld reinforcement on the inside of the pipe seam. This additional width of the helical groove in the die segments serves to accommodate several variables without compromising in any way the quality of the weld in the pipe, or the dimensional integrity of the pipe. Among the variables which must be accommodated by the additional width of the helical groove on the dies are: (a) changes in the helix angle of the pipe during expansion due to the diameter change without significant pitch length change and the slight pipe shortening as a normal result of the mechanical expansion operation; (b) slight changes in the helical pitch due to normal production tolerances and plate width variations; (c)

slight misorientations of the helical weld seam with respect to the expander head; and (d) relative circumferential shifts of the individual helical grooves in the expander segments during their radial movement and effective changes in the helix angle and width of the dies as the expansion occurs.

The pitch angle of the helical weld seam for the pipe may vary and is a function of such parameters as the width of the strip material and the diameter pipe to which the strip is rolled. An example of the relationships involved with helical welded tubing is set forth in J. Morris U.S. Pat. No. 3,201,559 issued Aug. 17, 1965.

In large diameter pipe, the pitch of the helical weld is considerably longer than the length of the pipe expander head 12 so that less than a full pitch of the helical weld seam on the pipe is disposed about the expander head during an incremental expansion operation. In addition, since there is some overlapping and transition between increments of expansion as the pipe is moved over the expanding head, the helical pipe weld seam 22 will not simply be maintained in alignment with the helical groove 28 on the expanding head if the pipe is just moved in the longitudinal direction.

Accordingly, in accordance with another aspect of the present invention, provision is preferably made to substantially, simultaneously rotate the pipe 20 as it is advanced incrementally over the expander head 12 so that the seam 22 corresponds with the helical groove 28 in the expander head 12. To this end, the conveyor support 24 includes several pairs of skewed rollers 31 which are driven through a flexible drive 32 or the like and electric or hydraulic motor 34. The arrangement is such that the drive rollers impart a frictional drive component to the pipe in a direction parallel to the axis of the helix that simultaneously advances the pipe 20 over the expander head and rotates the pipe to maintain weld orientation. The amount of skewing of the rollers is readily predetermined and may be adjusted to effect the desired amount of longitudinal movement of the pipe over the expanding head for the incremental expansion operation and the amount of rotation of the pipe is such that the weld seam 22 substantially corresponds with the helical groove 28 in the expander head 12.

In addition to the normal work hardening, sizing and rounding which are the expected results of mechanical expansion of pipe, we have found that the present invention also produces certain surprising and unexpected results with the spirally wound and helically welded pipe. Roll marks are created in the pipe during the rolling operation, which run parallel to the helically welded seam, and due to the staggered multiple roll setup required to helically bend the plates or coil to form the pipe, the roll marks are numerous and are unsightly to the appearance of the product. In addition, the roll marks give the end of the pipe a "flower-like" appearance, and create a mismatch situation which renders the butt welding of the pipes relatively difficult. Furthermore, where the spirally welded pipes are produced from a continuous length of butt-welded plates, there are crosswelds or T-shaped intersections of the welds in the finished pipes. Sometimes there are slight deviations from the nominal cylindrical profile of the pipe at the weld intersections during normal pipe production.

It has been found that the expanding operation on spirally wound and helically welded seam pipe in accordance with the present invention minimizes or reduces the roll marks as well as the amount of mismatch present at the intersections of welds, thereby improving the quality level of the finished pipe product.

It will be appreciated that by maintaining the helical seam in correspondence with the helical groove in the die assembly, the weld is not subjected to any compression or friction forces of the dies during expansion and the integrity of the weld is not compromised in any manner.

We claim as our invention:

1. The method of expanding pipe having a helically welded seam comprising the steps of moving the pipe over an expandable die head assembly adapted to be radially expandable within the pipe and including a helical groove on the surface of the die head, said groove arranged to conform with the helical weld seam of the pipe that is engaged by the die head assembly, expanding said die head assembly within the pipe and progressively advancing the pipe and rotating the same for subsequently incrementally expanding the pipe along its length with the helical weld seam being maintained in substantial conformity with the die head assembly groove.

2. The method as claimed in claim 1 wherein the steps of advancing and rotating the pipe are substantially simultaneously performed.

3. The method as claimed in claim 1 wherein said expanding step includes substantial removal of roll marks, weld mismatches and hardens, sizes and rounds the pipe.

4. Apparatus for radially expanding pipe having a helical weld seam comprising in combination, an elongated expandable die head assembly, means for radially expanding and contracting the die assembly, said die assembly having a helical groove disposed in the surface thereof adapted to conform with the helical weld seam of the pipe in contact therewith, means for supporting the pipe in axial alignment with the expander head, said support means including means for longitudinally advancing the pipe over said expander head to incrementally expand the pipe and rotating the pipe to maintain the helical weld seam in conformity with said helical groove on the expander head.

5. Apparatus as claimed in claim 4 wherein said means for longitudinally advancing and rotating the pipe simultaneously effects the advancement and rotating of the pipe.

6. Apparatus as claimed in claim 5 wherein said means for simultaneously, longitudinally advancing and rotating the pipe comprises at least one skewed driven roller carried by said support means so that the driven roller imparts a frictional drive component in the longitudinal direction and a frictional drive component in the transverse direction.

* * * * *